US007583026B2

(12) United States Patent
Nishitani et al.

(10) Patent No.: US 7,583,026 B2
(45) Date of Patent: Sep. 1, 2009

(54) PLASMA DISPLAY PANEL HAVING A PROTECTIVE LAYER PREVENTING AN INCREASE IN FIRING VOLTAGE

(75) Inventors: Mikihiko Nishitani, Nara (JP); Masaharu Terauchi, Nara (JP); Yukihiro Morita, Osaka (JP); Shinichi Yamamoto, Osaka (JP); Masatoshi Kitagawa, Osaka (JP)

(73) Assignee: Panasonic Corporation, Osaka (JP)

( * ) Notice: Subject to any disclaimer, the term of this patent is extended or adjusted under 35 U.S.C. 154(b) by 94 days.

(21) Appl. No.: 10/573,282

(22) PCT Filed: Oct. 29, 2004

(86) PCT No.: PCT/JP2004/016113

§ 371 (c)(1),
(2), (4) Date: Mar. 23, 2006

(87) PCT Pub. No.: WO2005/043578

PCT Pub. Date: May 12, 2005

(65) Prior Publication Data

US 2007/0001601 A1 Jan. 4, 2007

(30) Foreign Application Priority Data

Oct. 30, 2003 (JP) ..... 2003-370382

(51) Int. Cl.
*H01J 17/49* (2006.01)

(52) U.S. Cl. ..... 313/587

(58) Field of Classification Search ..... 313/587
See application file for complete search history.

(56) References Cited

U.S. PATENT DOCUMENTS

| | | | | |
|---|---|---|---|---|
| 6,242,864 | B1 * | 6/2001 | Nakahara et al. | 315/169.3 |
| 6,833,086 | B2 * | 12/2004 | Kajiwara | 313/486 |
| 7,193,363 | B2 * | 3/2007 | Kawashima | 313/509 |
| 7,432,656 | B2 * | 10/2008 | Morita et al. | 313/587 |

FOREIGN PATENT DOCUMENTS

| | | |
|---|---|---|
| EP | 1 420 434 A2 | 5/2004 |
| JP | 07-201280 | 8/1995 |
| JP | 08-236028 | 9/1996 |
| JP | 11-120920 | 4/1999 |
| JP | 11-339665 | 12/1999 |
| JP | 2000-173476 | 6/2000 |
| JP | 2000-215797 | 8/2000 |

(Continued)

OTHER PUBLICATIONS

Auday, G. et al., "Secondary Emission of Dielectrics Used in Plasma Display Panels", Journal of Applied Physics, vol. 88, No. 8, Oct. 15, 2000, American Institute of Physics, pp. 4871-4874.

*Primary Examiner*—Peter Macchiarolo

(57) ABSTRACT

In the plasma display panel of the present invention, a protective layer covers a dielectric layer covering electrodes in discharge cells and faces a discharge space filled with a discharge gas. Here, the discharge gas includes at least one selected from the group consisting of Xe and Kr. In the protective layer, an electron band including at least electrons having energy level of 4 eV or less below a vacuum level is formed within a forbidden band in energy bands.

8 Claims, 7 Drawing Sheets

FOREIGN PATENT DOCUMENTS

| | | | | |
|---|---|---|---|---|
| JP | 2001-076629 | | | 3/2001 |
| JP | 2001-332175 | | | 11/2001 |
| JP | 2003-100217 | | | 4/2003 |
| JP | 2003-132799 | | | 5/2003 |
| JP | 2003-272533 | | | 9/2003 |
| JP | 2003272533 | A | * | 9/2003 |
| JP | 2004-031264 | | | 1/2004 |
| WO | WO 03107391 | A1 | * | 12/2003 |
| WO | WO 2004049375 | A1 | * | 6/2004 |

* cited by examiner

PLASMA DISPLAY PANEL HAVING A PROTECTIVE LAYER PREVENTING AN INCREASE IN FIRING VOLTAGE

TECHNICAL FIELD

The present invention relates to a plasma display panel, and in particular to a protective layer that covers a dielectric layer.

BACKGROUND ART

In recent years, among display devices used for computers and televisions, plasma display panels (hereinafter referred to as "PDPs") are attracting attention as display devices that can provide a large screen while still being thin and lightweight.

PDPs are gas discharge panels in which images are displayed according to phosphors that emit light by being excited by ultraviolet (UV) radiation generated by a gas discharge. PDPs are divided into two types according to a method used to induce the discharge: AC (alternating current) PDPs and DC (direct current) PDPs, of which the former has especially become mainstream PDPs today because of their superiority over DC PDPs in terms of luminance, luminous efficiency and lifetime.

The structure of a common AC PDP is disclosed, for example, in Patent Reference 1 given below.

To be specific, a common AC PDP has a structure in which a front plate and a back plate arranged so as to oppose each other, and are sealed together at peripheral edges of the panels with sealing glass.

The front plate includes a front glass substrate that has display electrodes in a stripe formation disposed on one main surface thereof, and a dielectric layer formed on top of the display electrodes.

On the other hand, the back plate includes a back glass substrate that has address electrodes in a stripe formation disposed on one main surface thereof, the dielectric layer formed on top of the address electrodes, and successively a protective layer is formed on top of the dielectric layer. Barrier ribs are respectively formed between each two adjacent address electrodes, and phosphor layers are respectively formed between the adjacent barrier ribs after being formed.

The back plate and the front plate are arranged with their respective main surfaces opposing each other so that the electrodes formed on each of the plates are positioned perpendicular to each other. The peripheral edges of the back and front plates are sealed together to form an enclosed space therebetween which is filled with a discharge gas.

Each of the display electrodes is made up of a pair of electrodes with one referred to as an x-electrode and the other as a y-electrode.

An area where a pair of the display electrodes three-dimensionally crosses one address electrode over the discharge space corresponds to a cell that contributes to image display.

The protective layer that covers the dielectric layer formed on the panel glass on the front side of the PDP is formed to protect the dielectric layer from ion bombardment during discharge, and also functions as a cathode electrode that contacts the discharge space. Accordingly, it is noted that the properties of the protective layer exert a profound effect on discharge characteristics.

When a gas discharge is to be produced, first, electrons are emitted from the protective layer, which triggers the gas discharge.

Patent Reference 1 discusses that MgO, which is commonly used as a material for protective layers, is an ideal constituent of protective layers because of the high resistance to sputtering, and also indicates that the use of MgO lowers firing voltage Vf due to the high secondary electron emission coefficient of MgO.

Protective layers made from MgO are usually formed in a thickness of approximately 0.5 μm to 1 μm by vacuum deposition.

Recent years, an advanced television so-called HDTV (High-Definition Television) has progressively come into wide use in which image quality is improved by increasing the number of the scanning lines to be more than that of current television systems.

A standard NTSC system today widely used in Japan and North America has 525 scanning lines, however, an advanced television uses as many as 1125 or 1250 scanning lines.

In terms of PDPs also, there are great hopes for the development of ones having higher luminance and higher efficiency in order to realize high-definition image display as described above.

As the most effective method for achieving high luminance and high efficiency of PDPs, Nonpatent Reference 1 given below, for example, suggests increasing Xe partial pressure in the discharge gas.

The reason comes from the fact that increasing the Xe partial pressure in the discharge gas leads to producing a larger amount of UV radiation emitted when Xe returns to the ground state from an excited state.

[Patent Reference 1] Japanese Laid-Open Patent Application Publication No. H9-92133

[Nonpatent Reference 1] High Efficacy PDP, SID '03 Digest, p. 28

DISCLOSURE OF THE INVENTION

[Problems that the Invention is to Solve]

Increasing the Xe partial pressure in the discharge gas, however, results in reducing the number of Ne ions that largely contribute to the emission of secondary electrons from MgO of the protective layer. As a result, the amount of secondary electron emission is decreased, which in turn raises the firing voltage Vf.

Due to the increase of the firing voltage Vf, a driving circuit necessitates transistors with a higher pressure resistance level, which poses a problem of an increase in manufacturing costs of PDPs.

The present invention has been made in view of the stated issues, and aims at providing a protective layer which does not raise the firing voltage Vf to a large degree even when the Ne partial pressure in the discharge gas is decreased.

[Means to Solve the Problems]

In order to accomplish the stated object, in the PDP according to the present invention, a protective layer covers a dielectric layer covering electrodes in discharge cells and faces a discharge space filled with a discharge gas. Here, the discharge gas includes at least one selected from the group consisting of Xe and Kr. In the protective layer, an electron band including at least electrons having energy level of 4 eV or less below a vacuum level is formed within a forbidden band in energy bands.

[Advantageous Effects of the Invention]

In the PDP according to the present invention, a protective layer covers a dielectric layer covering electrodes in discharge cells and faces a discharge space filled with a discharge gas. Here, the discharge gas includes at least one selected from the group consisting of Xe and Kr. In the protective layer, an electron band including at least electrons having energy level of 4 eV or less below a vacuum level is formed within a forbidden band in energy bands.

A protective layer of a conventional PDP is generally made from magnesium oxide that has high resistance to sputtering. However, the forbidden band of magnesium oxide usually does not contain a region of space where electrons can reside, and electrons contributing to the secondary electron emission are ones present in the valence band.

In the protective layer of the PDP according to the present invention, an electron band at least including electrons having energy level up to 4 eV below the vacuum level is formed within the forbidden band, which facilitates emission of a larger amount of secondary electrons.

This is because, in order to emit a single secondary electron, one electron present in the electron band, which is located at energy level closer to the vacuum level when compared to the valence band, requires energy of only 4 eV or so, which is smaller than a conventionally required energy of 8.8 eV.

In addition, since the discharge gas includes at least one of Xe and Kr, energy required for emitting secondary electrons is readily obtained, which in turn facilitates emission of a larger amount of secondary electrons.

The reasons for this are that: electrons present in the electron band easily transit to the metastable state of Xe since the metastable state of Xe is located at energy level 4 eV below the vacuum level; and energy of approximately 8.1 eV is emitted when one electron in the metastable state of Xe transits to the ground state of Xe since the ground state of Xe is located at energy level 12.1 eV below the vacuum level.

In addition, since the metastable state of Kr is located at energy level 4 eV below the vacuum level, electrons in the electron band easily transit to the metastable state of Kr. Furthermore, since the ground state of Kr is located at energy level 14 eV below the vacuum level, energy of approximately 10 eV is emitted when an electron in the metastable state of Kr transits to the ground state of Kr.

In a conventional PDP, a mixed gas of Ne and Xe, or Ne, Xe and Kr is used as a discharge gas. Of them, Ne largely contributes to the secondary electron emission described above.

Accordingly, the amount of secondary electron emission is reduced as the Ne partial pressure is decreased.

However, with the protective layer of the present invention, even when the Ne partial pressure is decreased, Xe or Kr is used in place of the decrease in Ne to contribute to the secondary electron emission. As a result, a protective layer that does not raise the firing voltage Vf can be provided.

In addition, the protective layer may emit photoelectrons by energy of 4 eV or less obtained through light.

Herewith, energy required for the secondary electron emission can be supplied to electrons through light.

The light, here, means not only normal light but also a wider range of radiation including X rays.

In addition, the protective layer may be mainly composed of magnesium oxide.

Since being readily available and a proven material that has been used for a protective layer of conventional PDPs, magnesium oxide is suitable for practical application.

In addition, it is desirable that at least one selected from the group consisting of Group III, Group IV and Group VII elements be added to the magnesium oxide.

This assists electrons in residing in lattice defects generated in crystals of magnesium oxide in the protective layer, and the electron band is readily formed within the forbidden band.

In addition, one element selected from the group consisting of Ge and Sn may be added to the magnesium oxide.

This assists electrons in residing in lattice defects generated in crystals of magnesium oxide in the protective layer, and the electron band is readily formed within the forbidden band.

In addition, the magnesium oxide may include an oxygen deficit.

Due to the oxygen deficit, the electron band is readily formed within the forbidden band.

In order to accomplish the stated object, in the PDP according to the present invention, a protective layer covers a dielectric layer covering electrodes in discharge cells and faces a discharge space filled with a discharge gas. Here, the discharge gas includes at least Kr. In the protective layer, an electron band at least including electrons having energy level of 5 eV or less below a vacuum level is formed within a forbidden band in energy bands.

In the protective layer of the PDP, an electron band at least including electrons having energy level up to 5 eV below the vacuum level is formed within the forbidden band, which facilitates emission of a larger amount of secondary electrons.

This is because, in order to emit a single secondary electron, one electron present in the electron band, which is located at energy level closer to the vacuum level when compared to the valence band, requires energy of only 5 eV or so that is smaller than a conventionally required energy of 8.8 eV.

In addition, since the discharge gas includes at least Kr, energy required for emitting secondary electrons is readily obtained, which in turn facilitates emission of a larger amount of secondary electrons.

The reason for this is that energy of approximately 9 eV is emitted when one electron in the electron band transits to the ground state of Kr since the ground state of Kr is located at energy level 14 eV below the vacuum level.

In a conventional PDP, a mixed gas of Ne and Kr, or Ne, Xe and Kr is sometimes used. As described above, of them, Ne largely contributes to the secondary electron emission.

That is, even when the Ne partial pressure is decreased, Kr is used in place of the decrease in Ne to contribute to the secondary electron emission. As a result, a protective layer that does not raise the firing voltage Vf can be provided.

In addition, the protective layer may emit photoelectrons by energy of 5 eV or less obtained through light.

Herewith, energy required for the secondary electron emission can be supplied to electrons through light.

In addition, the protective layer may be mainly composed of magnesium oxide.

Since being readily available and a proven material that has been used as a protective layer of conventional PDPs, magnesium oxide is suitable for practical application.

In addition, it is desirable that at least one selected from the group consisting of Group III, Group IV and Group VII elements be added to the magnesium oxide.

This assists electrons in residing in lattice defects generated in crystals of magnesium oxide in the protective layer, and the electron band is readily formed within the forbidden band.

In addition, it is further desirable that one element selected from the group consisting of Ge and Sn is added to the magnesium oxide.

This assists electrons in residing in lattice defects generated in crystals of magnesium oxide in the protective layer, and the electron band is readily formed within the forbidden band.

In addition, the magnesium oxide may include an oxygen deficit.

Due to the oxygen deficit, the electron band is readily formed within the forbidden band.

BEST MODE FOR CARRYING OUT THE INVENTION

The PDP according to the present invention is described below with reference to drawings.

1. First Embodiment

Figure 1:
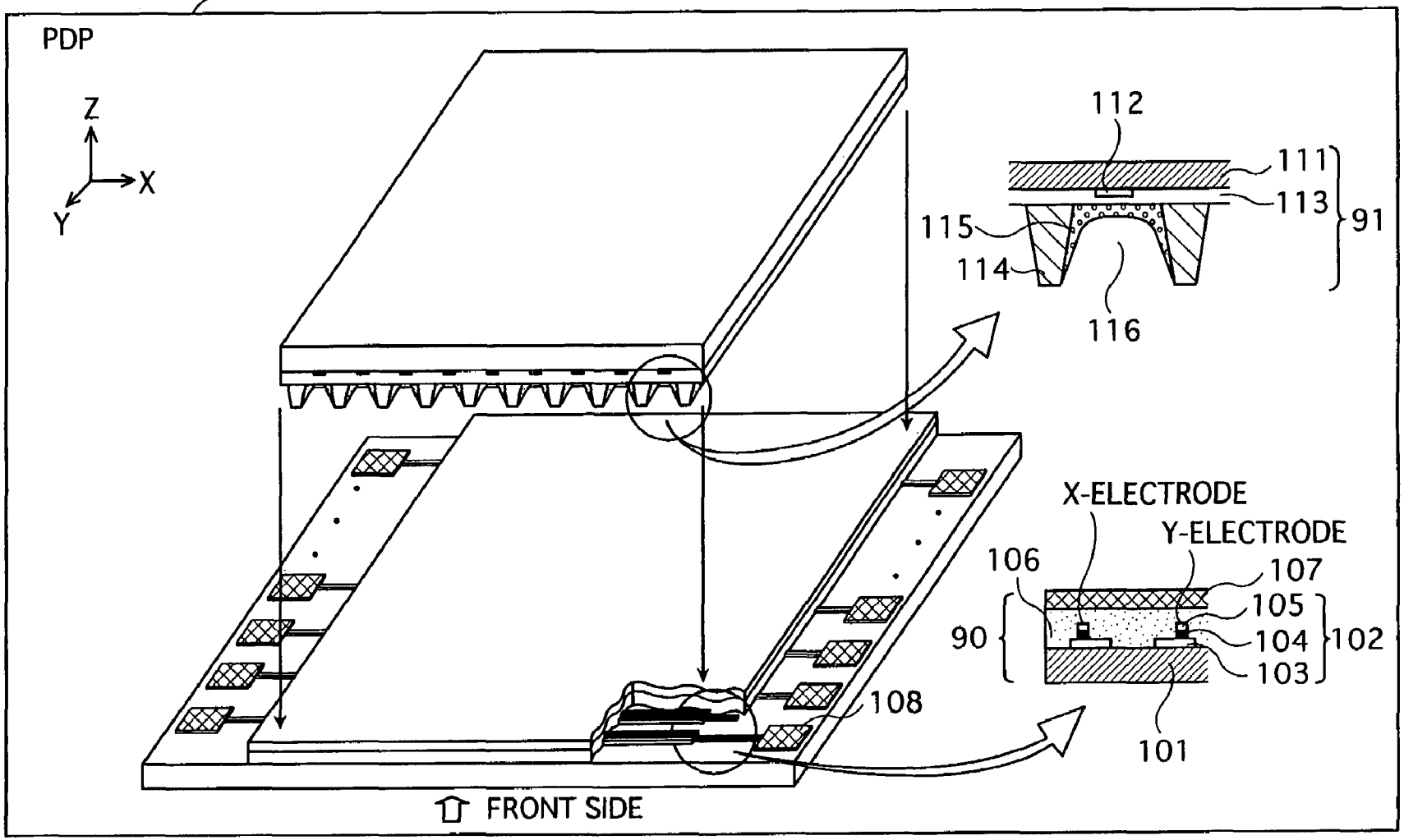
FIG. 1 is a schematic developed view showing an example of a PDP according to a first embodiment of the present invention.

FIG. 1 is a schematic developed view showing an example of a PDP according to a first embodiment of the present invention.

A PDP 100 has a structure in which a front plate 90 and a back plate 91 are arranged with their respective main surfaces opposing each other.

The front plate 90 is composed of a front glass substrate 101, a plurality of pairs of display electrodes 102, a dielectric layer 106, and a protective layer 107

The front glass substrate 101 is a base material layer for the front plate 90, and the display electrodes 102 are formed on one main surface of the front grass substrate 101. Each of the display electrodes 102 is made up of a transparent electrode 103, a black electrode film 104, and a bus electrode 105.

The black electrode film 104 functions as an antireflective layer which prevents reflection of outside light when the front glass substrate 101 is viewed from the rear side thereof since the main component, or ruthenium oxide, is black in color.

In addition, the bus electrode 105 brings about a reduction in the overall resistance since the main component of the bus electrode 105 is silver that has superior electrical conductivity.

The bus electrode 105 has, at one end in the longitudinal direction thereof, a rectangular terminal 108 in which the width of the electrode is locally expanded. The rectangular terminal 108 serves as an interface for connecting to a driving circuit.

The display electrodes 102 and the front glass substrate 101 are successively covered by the dielectric layer 106 and the protective layer 107 in the stated order.

The protective layer 107 is mainly made from magnesium oxide (MgO) and formed into a thin film with a thickness between 0.5 μm and 1.5 μm. Within the protective layer 107, an electron band at least including electrons having energy level up to 4 eV below the vacuum level is formed in the forbidden band, which is sandwiched between two energy bands, or the conduction band and the valence band.

To be more specific, the top of the electron band is located between 3.0 eV and 4.0 eV below the vacuum level while the bottom being located between 4.0 eV and 5.0 eV below the vacuum level.

The back plate 91 includes a back glass substrate 111, a plurality of address electrodes 112, a dielectric layer 113, a plurality of barrier ribs 114, and a plurality of phosphor layers 115 which are formed on the inside surface of gaps between each two neighboring barrier ribs 114.

The front plate 90 and the back plate 91 are disposed one on top of another and sealed together so that a discharge space 116 is formed between them, as shown in FIG. 1.

Note that, in order to facilitate the explanation of the structure, FIG. 1 illustrates as if the edges of the back plate 91 in the y-direction are open. However, in practice, the peripheral edges of the plate are joined and sealed with sealing glass.

The discharge space 116 is filled with a discharge gas composed of a mixture of neon (Ne) and xenon (Xe) at a pressure of approximately 66.7 kPa (500 Torr).

Here, the partial pressure of Xe is set to approximately 20%, which is higher than the Xe partial pressure in a discharge gas filling a standard PDP (approximately 7-10%).

The area where each pair of neighboring display electrodes 102 cross one address electrode 112 over the discharge space 116 corresponds to a cell that contributes to image display.

As described above, every single cell is intersected by two display electrodes with one referred to as an x-electrode and the other as a y-electrode, which are arranged in an alternate manner.

In the PDP 100, first, address discharge is performed by applying a voltage between x-electrodes and address electrodes 112 intersecting cells to be illuminated, and then, sustain discharge is generated by applying a pulse voltage to both the x-electrodes and y-electrodes intersecting those cells.

In the discharge space 116, UV radiation is generated according to the sustain discharge, and the generated UV radiation hits the phosphor layers 115. Herewith, the UV radiation is converted to visible light and the cells are illuminated, which results in image display.

The dielectric layer 106 has a current restricting function that is characteristic to AC PDPS, and contributes to enabling AC PDPs to have a longer lifetime than DC PDPS.

The barrier ribs 114 partition neighboring discharge cells from each other, and serve to prevent erroneous discharge and optical crosstalk in the x-direction in FIG. 1.

[Full Details Regarding Protective Layer]

Figure 2:
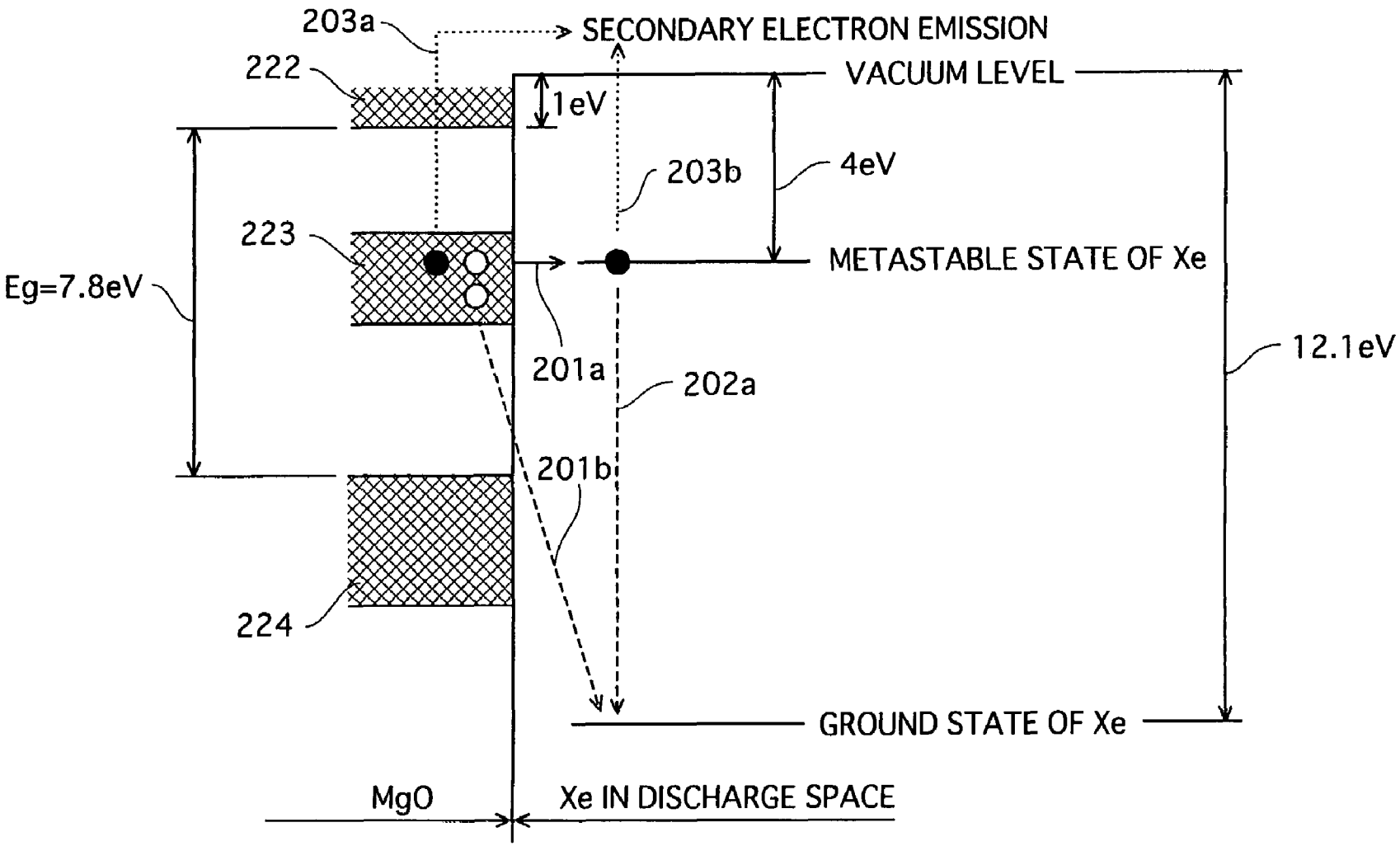
FIG. 2 illustrates state transition paths of electrons involved in energy exchange between a protective layer and gas enclosed in discharge cells of the PDP according to the first embodiment.

FIG. 2 illustrates state transition paths of electrons involved in energy exchange between the protective layer 107 and gas enclosed in the discharge space 116 of the PDP 100 according to the first embodiment.

Hereinafter in this description, a difference between the vacuum level and energy level of a given state within energy bands is called an "energy depth", for the sake of convenience.

Paying attention to the fact that the metastable state of Xe has energy depth of approximately 4 eV, the inventors made the following discovery through keen examinations. In the forbidden band sandwiched between the conduction band and the valence band within the energy bands of the protective layer 107, a position at which the energy depth becomes 4 eV is chosen as a reference energy level (hereinafter, a "first reference level"). Then, Xe ions can be made to contribute to secondary electron emission when a region of space where electrons can occupy, i.e. an electron band 223, is created, within the forbidden band, adjacent to the first reference level on the side closer to the vacuum level.

Herewith, when Xe ions generated in the discharge space 116 come to where interaction with the surface of the protective layer 107 takes place, secondary electrons are emitted according to two state transition paths as follows.

State Transition Path I: (1) an electron present in the electron band 223 of the protective layer 107 transits to the metastable state of Xe having energy depth of 4 eV (201*a* in FIG. 2); (2) then, the electron now in the metastable state further transits to the ground state having energy depth of 12.1 eV (202*a* in FIG. 2); and (3) thereby, another electron present in the electron band of the protective layer 107 receives energy of approximately 8.1 eV through the Auger effect, and jumps across energy depth of approximately 4 eV to be thereby ejected to the discharge space 116 as a secondary electron (203*a* in FIG. 2).

State Transition Path II: (1) an electron present in the electron band 223 of the protective layer 107 transits to the metastable state of Xe (201*a* in FIG. 2); (2) then, another electron in the electron band 223 of the protective layer 107 transits to the ground state (201*b* in FIG. 2); and (3) herewith, a third electron in the metastable state of Xe receives energy of approximately 8.1 eV through the Auger effect, and jumps across energy depth of approximately 4 eV to be thereby ejected to the discharge space 116 as a secondary electron (203*b* in FIG. 2).

Since a discharge gas normally includes not only Xe but also Ne, secondary electrons are also emitted by the interaction between the Ne and the protective layer 107, as is conventionally done.

Figure 3:
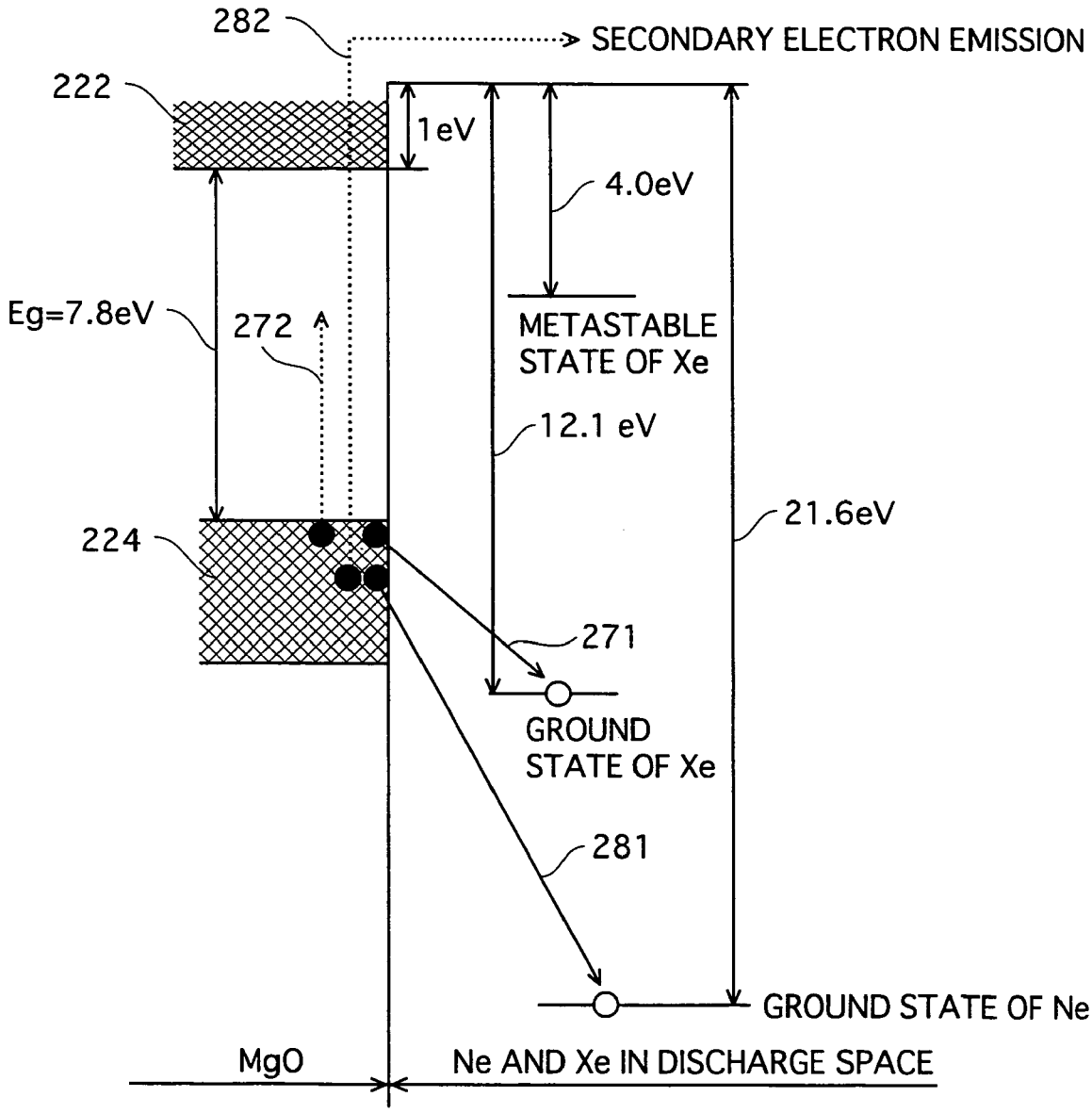
FIG. 3 illustrates state transition paths of electrons involved in energy exchange between a protective layer and gas enclosed in discharge cells of a conventional PDP.

On the other hand, in a conventional PDP in which the electric-level band 223 is not created in a protective layer thereof, even when Xe ions in the discharge space come to where interaction with the protective layer takes place, no secondary electron is emitted. As shown in FIG. 3, the reason for this is because even if an electron present in a valence band 224 having energy depth of at least 8.8 eV transits to the ground state of Xe having energy depth of 12.1 eV (271 in FIG. 3), energy given to another electron in the valence band 224 is less than the amount required to jump across energy depth of approximately 8.8 eV between the valence band 224 and the vacuum level since the energy depth before and after the transition is small with only about 3.3 eV. As a result, the given energy is consumed within the protective layer (272 in FIG. 3), and no secondary electron is emitted.

On the contrary, when Ne ions in the discharge space 116 come to where interaction with the protective layer takes place, secondary electrons can be emitted to the discharge space 116. This is because when an electron present in the valence band 224 transits to the ground state of Ne having energy depth of 21.6 eV (281 in FIG. 3), another electron in the valence band 224 of the protective layer receives energy of approximately 12.8 eV through the Auger effect and jumps across energy depth of approximately 8.8 eV to be thereby ejected to the discharge space 116 as a secondary electron (282 in FIG. 3).

Namely, the secondary electron emission of a conventional PDP is solely due to the Ne ions. Therefore, when the Ne partial pressure is decreased while the Xe partial pressure being increased, the amount of secondary electron emission is also decreased accordingly.

As has been described above, in the PDP 100 according to the first embodiment, the electron band 223 is created in the protective layer 107. Herewith, the Xe ions, which cannot conventionally be involved in the secondary electron emission in spite of being in the range where interaction with the protective layer 107 takes place, can be made to contribute to the secondary electron emission.

[Confirmatory Examination]

Figure 4:
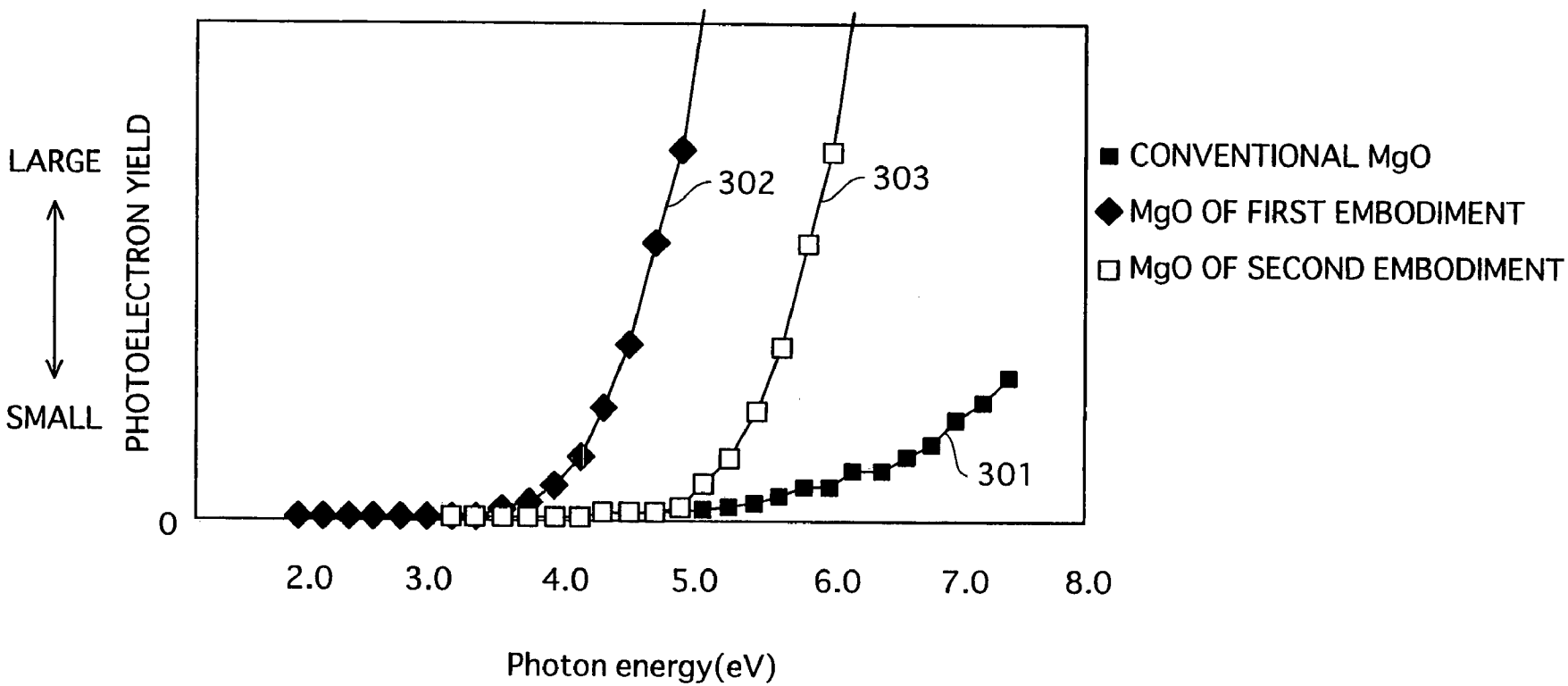
FIG. 4 shows measurement results of the amounts of electrons emitted from protective layers of PDPs when each of the protective layers was irradiated with light (i.e. photoelectron yield)

FIG. 4 shows measurement results of the amount of electrons emitted from the protective layer 107 when the protective layer 107 mainly made from MgO was irradiated with light (i.e. photoelectron yield).

In FIG. 4, 302 denotes a measurement result for the protective layer 107 according to the first embodiment while 301 denoting a measurement result for a conventional protective layer.

As is clear from the figure, the protective layer 107 of the first embodiment emits a sufficient amount of photoelectrons with light irradiation of 4 eV or more, although the conventional protective layer emits hardly any amount of electrons with light irradiation of 4 eV or more.

These results coincide with the fact that electrons are present at energy level 4 eV below the vacuum level in the protective layer 107 of the first embodiment, as shown in FIG. 2, while the conventional protective layer has insufficient electrons at the energy level 4 eV below the vacuum level, as shown in FIG. 3.

Figure 5:
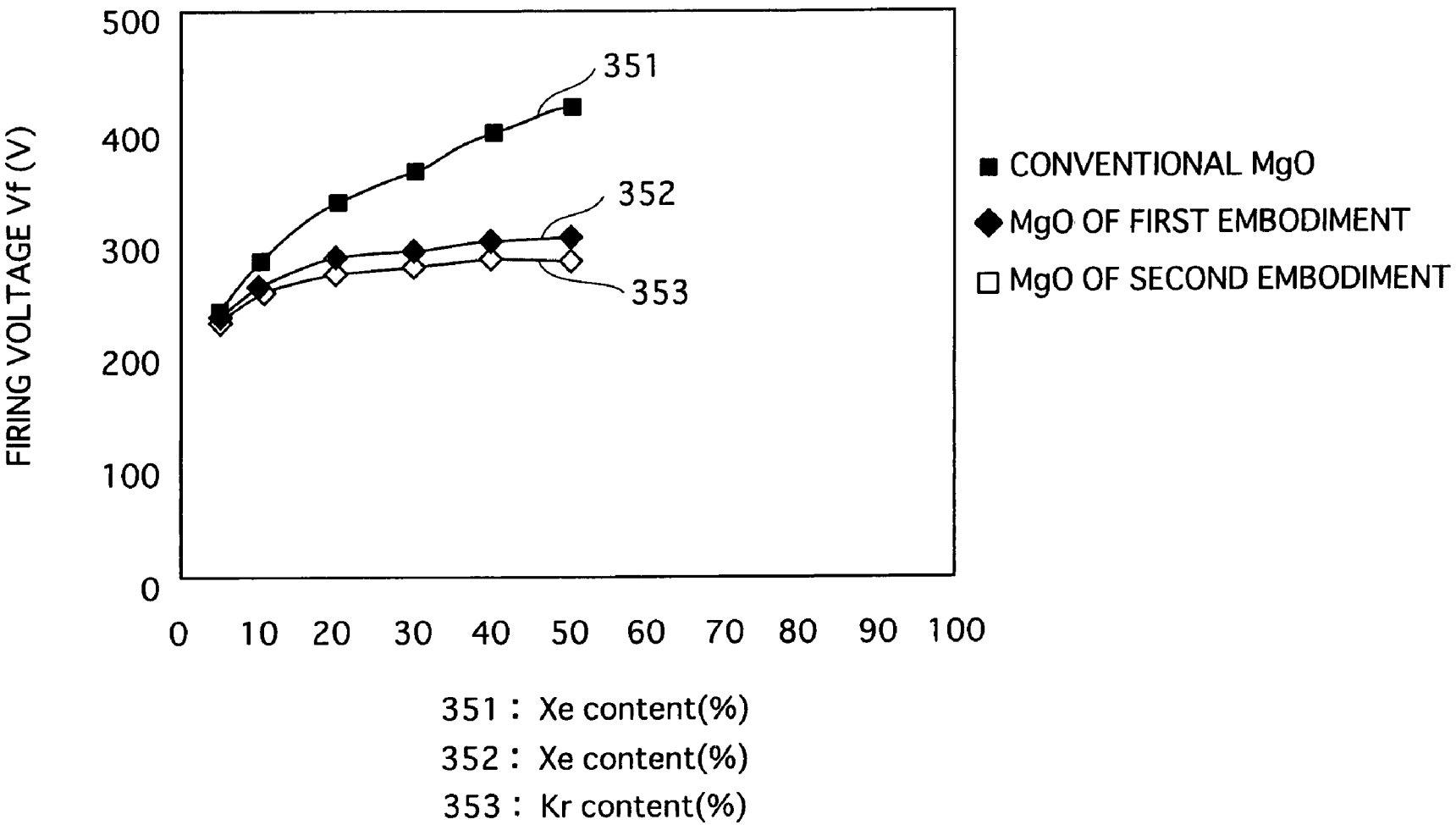
FIG. 5 shows relationships between firing voltage Vf of a discharge cell and partial pressure of one constituent gas included in discharge gas of in PDPs.

FIG. 5 shows relationships between firing voltage Vf of a discharge cell and partial pressure of one constituent gas included in the discharge gas in PDPS.

To be more specific, 352 in FIG. 5 denotes a result obtained when the protective layer 107 of the first embodiment was applied to a PDP while 351 in the figure denoting a result obtained when a conventional protective layer was applied to a PDP.

As shown in the figure, it has been found that the difference between the protective layer 107 of the first embodiment and the conventional protective layer becomes marked when the Xe partial pressure is high.

In more detail, the PDP to which the protective layer 107 of the first embodiment was applied had a firing voltage Vf of no more than 300 V even when the Xe partial pressure was 50%. On the other hand, the PDP equipped with the conventional protective layer had a firing voltage Vf exceeding 400 V.

As has been described, in the present invention, a mixed gas of Ne and Xe is used as the discharge gas. However, it may also be effective to form a discharge gas by combining elements other than these two and apply the formed discharge gas to a PDP, together with the protective layer 107 of the first embodiment.

For example, it is also effective to apply a discharge gas including Kr and produce UV radiation by the relaxation of Kr and Kr excimer in the excited state. This is because the metastable state of Kr lies at energy level a little over 4 eV below the vacuum level.

Specifically speaking, the firing voltage Vf can be lowered when the main gas in the discharge space 116, composed of either one of the following sets, is used together with the protective layer 107 mainly made from MgO of the first embodiment: Ne and Xe; Ne and Kr; Kr and Xe; Ne, Xe and Kr; Kr alone; and Xe alone.

It is known that a protective layer made from MgO is subject to corrosion due to electrical discharge in a PDP. However, the degree of the corrosion can be alleviated by, instead of using a mixture of only Ne and Xe for the discharge gas as is conventionally done, using a discharge gas with a mixture of Ne, Xe and Kr, where a part of Ne in the conventional mixture has been replaced by Kr.

The reason that the corrosion of a protective layer is alleviated by replacing a part of Ne by Kr is related to the masses of Ne and Kr. When accelerated in a strong electric field, Kr ions are accelerated less easily than Ne ions since Kr has a larger mass than Ne. As a result, the velocity of Kr colliding against the surface of the protective layer 107 is reduced.

[Method for Creating Electronic-Level Band in Protective Layer]

The protective layer 107 is formed by an electron beam deposition method or a sputtering deposition method. The following gives a specific example of how to form the protective layer 107.

Note that sintered MgO or powdered MgO is used in all deposition methods described hereinafter.

The substrate temperature is in the range of 200° C. to 300° C.

As to external impurities, adequate doses of, for example, Ge, Sn, and the like in the form of oxide are mixed into the sintered MgO or powdered MgO so as to be used as evaporation sources or sputtering targets.

It is desirable to control native vacancies, in particular oxygen vacancies, by adequately adjusting the amount of oxygen introduced during the deposition process.

Figure 6:
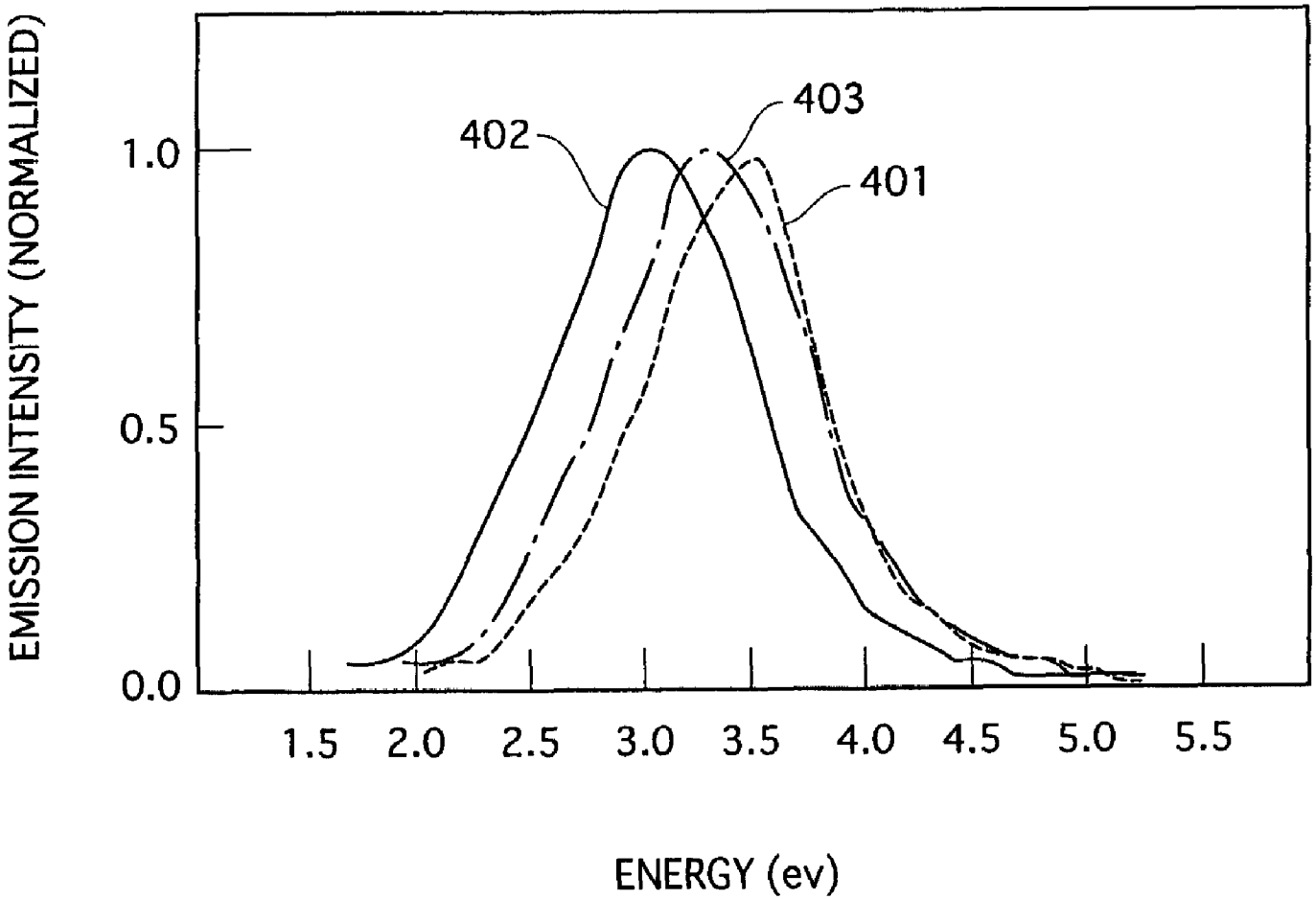
FIG. 6 shows results of a cathode luminescence evaluation.

FIG. 6 shows results of a cathode luminescence evaluation in which physical properties in microregions, vacancies, and impurities are evaluated by using cathode luminescence induced from test samples by electron beam irradiation.

The conventional protective layer has a composition substantially identical to the stoichiometric ratio of MgO, and, as indicated with 401 in FIG. 6, has an emission peak at energy level of approximately 3.5 eV according to the cathode luminescence evaluation.

The following gives an example of how to create the above-mentioned electron band 223 in the protective layer 107 of the first embodiment.

[1] The peak emission of cathode luminescence of MgO can be set at energy level of approximately 3 eV, as indicated with 402 in FIG. 6, by: (a) adjusting the amount of oxygen to be introduced as well as constituents of residual gas in a MgO film formation process; and (b) thereby setting the oxidation-reduction state of MgO to be in a slightly more reduced state as compared to the stoichiometric ratio.

First, conditions of the MgO film formation for obtaining such an emission peak are found so as to make the MgO film, used for the protective layer 107, reproducible, and then either one or both of two methods to be hereinafter described are implemented. Herewith, the electron band can be created in the protective layer 107.

[2-1] Adding Adequate Doses of External Impurities to the MgO Film:

Here, the external impurities include at least one of a Group III element, a Group IV element, and a Group VII element.

To be more specific, it has been found from experiment that Al, C, Si, Ge, Sn, Cl, F, and the like are effective. In particular, a Group IV element such as C, Si, Ge, and Sn is desirable, and Ge and Sn are more desirable since these elements have a larger ionic radius than magnesium. Because having a larger atomic radius than MgO, Ge and Sn have an adverse effect on the crystallinity of the MgO film when added in large quantity. Therefore, it is desirable that Ge and Sn be added to be no more than 0.01%.

Even when impurities are introduced to the MgO film as described above, the emission peak in the cathode luminescence evaluation is hardly shifted.

[2-2] Forming an Oxygen Deficit in the MgO Film:

Herewith, energy level is formed in the intermediate position of the forbidden band of the MgO film. This means that the Fermi level is raised overall, which allows electrons to exist in the energy level.

Note that how to create the electron band in the MgO film composing the protective layer 107 is not limited to the above-mentioned method.

For example, the MgO film having electrons at energy level 4 eV below the vacuum level therein may be produced by a MgO film formation process.

In the first embodiment, MgO is used as a main constituent material of the protective layer 107, however, the first embodiment is not limited to this. The protective layer may be mainly made from a material other than MgO as long as the protective layer is transparent, provides insulation, and has electrons at energy level 4 eV below the vacuum level.

2. Second Embodiment

Next is described a protective layer and a discharge gas of a PDP according to a second embodiment of the present invention.

The PDP of the second embodiment has a characteristic feature in which the amount of secondary electrons emitted from the protective layer is less likely to decrease even when the Ne partial pressure in the discharge gas is reduced, as with the PDP 100 of the first embodiment. Structurally speaking, the second embodiment differs from the first embodiment only in a position of the electron band created in the protective layer and a composition of the discharge gas.

The following description gives details of the differences from the first embodiment, i.e. the protective layer and the discharge gas, while omitting mention of other components of the PDP.

The discharge gas filling the discharge space is made of a mixed gas including Kr.

More specifically speaking, the discharge gas is composed of either one of the following sets: Ne and Kr; Kr and Xe; Ne, Xe and Kr; and Kr alone. Of them, using a mixed gas of Ne, Xe and Kr for the discharge gas is more preferable in order to produce UV radiation that covers the entire wavelength range of UV absorption of existing phosphors as much as possible.

The protective layer is mainly made from MgO and formed into a thin film of 0.5 μm to 1 μm thickness, and has an electron band at least including electrons having energy level up to 5 eV below the vacuum level within the forbidden band, which is sandwiched between two energy bands, or the conduction band and the valence band.

To be more specific, the top of the electron band is located between 4.0 eV and 5.0 eV below the vacuum level while the bottom being located between 5.0 eV and 6.0 eV below the vacuum level.

[Full Details Regarding Protective Layer]

Figure 7:
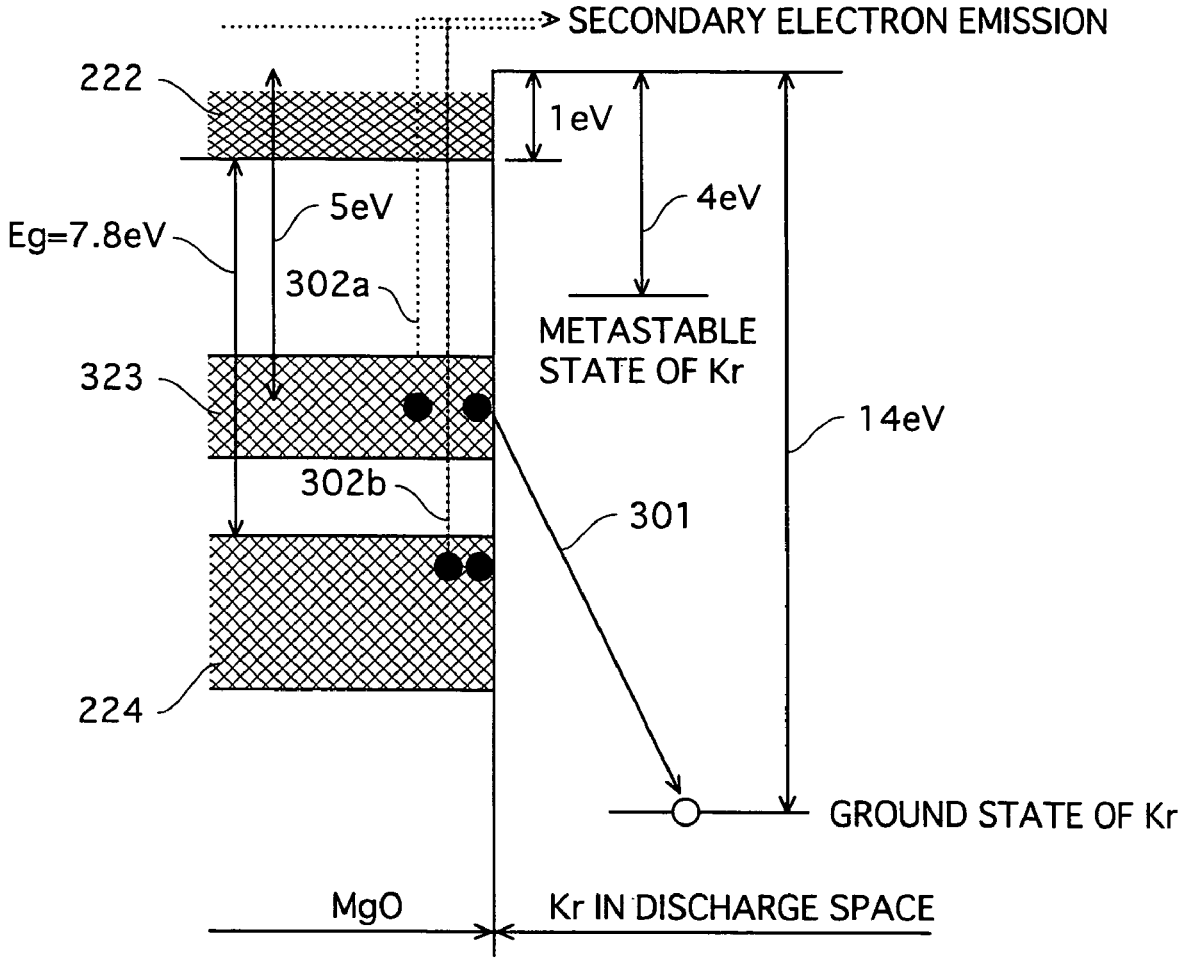
FIG. 7 illustrates state transition paths of electrons involved in energy exchange between a protective layer and gas enclosed in discharge cells of a PDP according to a second embodiment.

FIG. 7 illustrates state transition paths of electrons involved in energy exchange between the protective layer and gas enclosed in the discharge space in the PDP according to the second embodiment.

Paying attention to the fact that the ground state of Kr has energy depth of approximately 14 eV, the inventors made the following discovery through keen examinations. In the forbidden band sandwiched between the conduction band and the valence band within the energy bands of the protective layer, a position at which the energy depth becomes 5 eV is chosen as a reference energy level (hereinafter, a "second reference level") Then, Kr ions can be made to contribute to secondary electron emission when a region of space where electrons can occupy, i.e. an electron band 323, is created, within the forbidden band, adjacent to the second reference level on the side closer to the vacuum level.

In this case, the production of UV radiation which conventionally relies largely on Xe is realized by the relaxation of Kr and Kr excimer in an excited state.

Herewith, when Kr ions generated in the discharge space come to where interaction with the surface of the protective layer takes place, secondary electrons are emitted according to two state transition paths as follows.

State Transition Path I: (1) an electron present in the electron band 323 of the protective layer transits to the ground state of Kr having energy depth of 14 eV (301 in FIG. 7); and (2) herewith, another electron in the electron band 323 of the protective layer receives energy of approximately 9 eV through the Auger effect, and jumps across energy depth of approximately 5 eV to be thereby ejected to the discharge space as a secondary electron (302*a* in FIG. 7).

State Transition Path II: (1) an electron present in the electron band 323 of the protective layer transits to the ground state of Kr (301 in FIG. 7); and (2) herewith, another electron in the valence band 224 of the protective layer receives energy of approximately 9 eV through the Auger effect, and jumps across energy depth of approximately 8.8 eV to be ejected to the discharge space as a secondary electron (302*b* in FIG. 7).

On the other hand, in a conventional PDP in which the electron band 323 is not created in a protective layer thereof, even when Kr ions in the discharge space come to where interaction with the protective layer takes place, no secondary electron is emitted. The reason for this is because even if an electron present in the valence band 224 having energy depth of at least 8.8 eV transits to the ground state of Kr having energy depth of 14 eV, energy given to another electron in the valence band 224 is less than the amount required to jump across energy depth of approximately 8.8 eV between the valence band 224 and the vacuum level since the energy depth before and after the transition is small with only about 5.2 eV. As a result, the given energy is consumed within the protective layer, and no secondary electron is emitted.

As has been described above, in the PDP according to the second embodiment, the electron band 323 is created in the protective layer. Herewith, the Kr ions, which can hardly be involved in the secondary electron emission from the protective layer in a conventional PDP, can be made to contribute to the secondary electron emission.

[Confirmatory Examination]

The following description is provided, referring back to FIG. 4.

As mentioned above, FIG. 4 shows measurement results of the amounts of electrons emitted from respective protective layers when each of the protective layers was irradiated with light.

In FIG. 4, 303 denotes a measurement result for the protective layer according to the second embodiment while 301 denoting a measurement result for a conventional protective layer.

As is clear from the figure, the protective layer of the second embodiment emits a sufficient amount of electrons with light irradiation of 5 eV or more, although the conventional protective layer emits hardly any amount of electrons with light irradiation of 5 eV or more.

These results coincide with the fact that electrons are present at energy level 5 eV below the vacuum level in the protective layer of the second embodiment, as shown in FIG. 7, while the conventional protective layer has insufficient electrons at the energy level 5 eV below the vacuum level, as shown in FIG. 3.

FIG. 5 shows relationships between firing voltage Vf of a discharge cell and partial pressure of one constituent gas included in the discharge gas in PDPs.

353 in FIG. 5 denotes a result obtained when a protective layer of the second embodiment was applied to a PDP together with a Ne—Kr discharge gas, while 351 in the figure denoting a result obtained when a protective layer made of a conventional protective layer was applied to a PDP together with a Ne—Xe discharge gas, as mentioned above.

As shown in the figure, it has been found that the difference between the protective layer of the second embodiment and the conventional protective layer becomes marked when the Kr partial pressure is high.

In more detail, the PDP to which the protective layer of the second embodiment was applied had a firing voltage Vf of no more than 280 V even when the Kr partial pressure was 50%. On the other hand, the PDP equipped with the conventional protective layer had a firing voltage Vf exceeding 400 V.

[Method for Creating Electronic-Level Band in Protective Layer]

A method for creating the above-stated electron band in the protective layer is substantially the same as in the first embodiment, and the electron band can be created by adding adequate doses of external impurities to material of the protective layer and/or forming an oxygen deficit in a MgO film. Only differences from the first embodiment are described below.

The following gives an example of how to create the above-mentioned electron band 323 in the protective layer of the second embodiment.

[1] The peak emission of cathode luminescence of MgO can be set at energy level of approximately 3.3 eV, as indicated with 403 in FIG. 6, by: (a) adjusting the amount of oxygen to be introduced as well as constituents of residual gas in the MgO film formation process; and (b) thereby setting the oxidation-reduction state of MgO to be in a slightly more reduced state as compared to the stoichiometric ratio.

The MgO film aimed in the second embodiment is achieved by, first, finding conditions of the MgO film formation, and then, adding adequate doses of required external impurities, as in the first embodiment.

At this point, the addition amounts of the impurities are adjusted so that the cathode luminescence of the MgO film after the impurities are introduced thereto has an emission peak shifted approximately 0.5 eV to the higher energy side, i.e. the emission peak of 403 shown in FIG. 6, or 3.3 eV.

Besides, the MgO film aimed in the second embodiment can be achieved by adding adequate doses of external impurities to the MgO film and/or forming an oxygen deficit in the MgO film, as in the first embodiment.

In the second embodiment, MgO is used as a main constituent material of the protective layer, however, the second embodiment is not limited to this. The protective layer may be made from a material other than MgO as long as the protective layer is transparent, provides insulation, and has electrons at energy level 5 eV below the vacuum level.

INDUSTRIAL APPLICABILITY

The invention of the present application is applicable to high-definition display devices used for televisions, computer monitors, and the like.

The invention claimed is:

1. A plasma display panel in which a protective layer covers a dielectric layer covering electrodes in discharge cells and faces a discharge space filled with a discharge gas, wherein the discharge gas includes Xe whose partial pressure is no less than 20%, and in the protective layer, an electron band including at least electrons having energy level of 4 eV or less below a vacuum level is formed within a forbidden band in energy bands.

2. The plasma display panel of claim 1, wherein the protective layer emits photoelectrons by energy of 4 eV or less obtained through light.

3. The plasma display panel of claim 2, wherein the protective layer is mainly composed of magnesium oxide.

4. The plasma display panel of claim 3, wherein at least one selected from the group consisting of Group III, Group IV and Group VII elements is added to the magnesium oxide.

5. The plasma display panel of claim 4, wherein the magnesium oxide includes an oxygen deficit.

6. The plasma display panel of claim 3, wherein one element selected from the group consisting of Ge and Sn is added to the magnesium oxide.

7. The plasma display panel of claim 6, wherein the magnesium oxide includes an oxygen deficit.

8. The plasma display panel of claim 3, wherein the magnesium oxide includes an oxygen deficit.

* * * * *